US007942081B2

(12) United States Patent
Hauk et al.

(10) Patent No.: US 7,942,081 B2
(45) Date of Patent: May 17, 2011

(54) AUTOMATICALLY ADJUSTABLE POWER JAW

(75) Inventors: Thomas D Hauk, Palm Desert, CA (US); Anthony B. Jorda, Cypress, CA (US); Raul H. Perez, Hawthorne, CA (US); Michael Ernest Rivera, Garden Grove, CA (US)

(73) Assignee: Hawk Industries, Inc., Signal Hill, CA (US)

( * ) Notice: Subject to any disclaimer, the term of this patent is extended or adjusted under 35 U.S.C. 154(b) by 115 days.

(21) Appl. No.: 12/200,776

(22) Filed: Aug. 28, 2008

(65) Prior Publication Data

US 2010/0050817 A1 Mar. 4, 2010

(51) Int. Cl.
*B25B 13/50* (2006.01)
*B25B 13/14* (2006.01)

(52) U.S. Cl. ..... 81/57.19; 81/129; 81/165

(58) Field of Classification Search ..... 81/57.19, 81/57.16, 57.17, 57, 57.11, 57.21, 126, 165, 81/127–129, 131–64, 166–176

See application file for complete search history.

(56) References Cited

U.S. PATENT DOCUMENTS

| | | | | |
|---|---|---|---|---|
| 5,060,542 | A | 10/1991 | Hauk | |
| 5,386,746 | A | 2/1995 | Hauk | |
| 5,868,045 | A | 2/1999 | Hauk | |
| 6,374,706 | B1 * | 4/2002 | Newman | 81/57.34 |
| 6,745,646 | B1 * | 6/2004 | Pietras et al. | 81/57.34 |
| 6,935,210 | B2 | 8/2005 | Hauk et al. | |
| 7,028,585 | B2 * | 4/2006 | Pietras et al. | 81/57.16 |
| 2002/0078798 | A1 * | 6/2002 | Castille | 81/57.34 |
| 2005/0076744 | A1 | 4/2005 | Pietras et al. | |
| 2005/0121907 | A1 * | 6/2005 | Le Devehat et al. | 285/320 |

* cited by examiner

*Primary Examiner* — David B Thomas
(74) *Attorney, Agent, or Firm* — The Eclipse Group LLP

(57) ABSTRACT

An improved jaw apparatus is provided for making or breaking a tubular pipe connection. The jaw includes a head adapted to receive a hook having a threaded shank end. The threaded shank end is engaged at the head end opposite the hook end by a hydraulic powered nut adjustment assembly. The adjustment assembly may be operated by a control unit to allow for the automatic opening and closing of the jaw for receiving pipes of varying diameters.

18 Claims, 12 Drawing Sheets

AUTOMATICALLY ADJUSTABLE POWER JAW

BACKGROUND OF THE INVENTION

1. Field of the Invention

The present invention generally relates to equipment used in the maintenance and servicing of oil and gas production wells, and more particularly, relates to power jaws or wrenches of the type used in conjunction with making or breaking threaded joints between successive tubing elements that make-up the continuous tubing string extending through a well bore into the underground deposits.

2. Related Art

In the construction of oil or gas wells, it is usually necessary to construct long drill pipes. Due to the length of these pipes, sections of pipe are progressively added to the pipe string as it is lowered into the well from a drilling platform. It is common practice to use wrench assemblies to apply a predetermined torque to make-up or break out the drill pipe connections. The wrench assemblies are typically located on a platform, either on rails or hung from a derrick on a chain. Examples of prior art wrench assemblies are described in U.S. Pat. Nos. 5,060,542; 5,386,746 and 5,868,045 all issued to inventor Thomas D. Hauk. The text of all three U.S. Pat. Nos. 5,060,542, 5,386,746 and 5,868,045 are incorporated by reference in their entirety into this application.

To make-up or break out a threaded pipe connection, the wrench assemblies of the prior art general include the use of an active (or wrenching) jaw device that supplies torque to the section of pipe above or below the threaded connection, while a passive (or back up) jaw device supplies a reaction torque below or above the threaded connection, respectively, depending upon whether the pipe connection is being made-up or broken out. Particularly, the prior art wrench assemblies described in U.S. Pat. Nos. 5,060,542; 5,386,746 and 5,868,045 disclose the use of three levels of jaws, where the jaws at each level are of a type that energize when turned in a predetermined direction so as to have a stronger grip on the pipe when turned in such direction. The jaws on the top and bottom levels are oriented so as to turn the pipe in one direction, while the jaw on the middle level is oriented to turn the pipe in the opposite direction. The upper, middle and lower jaws are positioned in vertically spaced relationship and connected together in a self-contained tool or wrench assembly. The upper and lower jaws are fixed to a common frame, whereas the middle jaw is pivotally connected between the upper and lower jaws on the common frame.

To form a pipe joint, the top pipe section is rotated (spun up), as by a spinning tool, until only final tightening is required. Then, the wrench assembly is adjusted such that the upper jaw engages a section of the pipe just above the pipe joint. The middle jaw then engages the section of the pipe just below the pipe joint. The lower jaw is positioned below the tool joint, being then adjacent to the pipe itself, but does not engage the pipe when the joint is being made-up. The upper and middle jaws are then closed on the pipe, following which the upper jaw set is rotated to make the joint. Thereafter, the upper and middle jaw sets are opened so as to release the tightened pipe joint.

To break (or loosen) a joint prior to unthreading, as by spinning out by use of a conventional spinning tool, the wrench assembly is moved vertically such that the middle jaw engages the pipe assembly just above the joint and the lower jaw engages the pipe assembly just below the lower joint. When loosening a joint, the upper jaw is usually positioned above the joint but is not in engagement with the pipe assembly. The middle and lower jaws are then closed on the pipe assembly above and below the joint respectively. The middle jaw is then rotated counterclockwise to break or loosen the joint.

In summary, making of a pipe joint is accomplished by locking the middle jaws on the bottom portion of a pipe joint, and employing the top and middle jaws to turn the top portion of the pipe joint clockwise. Breaking of a joint is accomplished by locking the bottom jaws on the bottom pipe joint portion, and employing the middle and bottom levels of jaws to rotate the top portion of the pipe joint counterclockwise.

The jaws of the current wrench assemblies are capable of adapting to receive pipes of various diameters. As described in the referenced patents, each jaw includes a hook having a shank end extending from the hook. The shank end is threaded. A head is also provided that is adapted to receive the shank end of the hook. A nut assembly is provided at the end of the head opposite the hook for threadedly engaging the shank end of the hook. The nut includes handles that facilitate the manually turning of the nut in either direction to open and close the hook end of the jaw to receive pipes of varying diameters. The relationship between the nut, hook and head are such that the rotation of the nut causes the jaw to open or close to a desired position relative to the particular diameter of the pipe joint.

To make-up or break out a drill pipe connection, high torque must be supplied over a large angle which is supplied through energizing the jaws. The jaws are initially energized by providing fluid-operated grip cylinders that pivot the hook and head relative to one another, closing and thereby tighten the grip the jaw has on the pipes. The initial engagement of the pipe by the grip cylinders commences the torquing, which allows subsequent torquing to be more effective. Other fluid-operated means, such as a hydraulic torque cylinder, are then provided to effect the torquing.

As explained above, while the prior art jaws include automated mechanisms for gripping the pipe and for applying high torque to the jaws, the prior art jaws still require manual adjustment of the wrenches to allow for the receipt of pipes of varying diameter. As such, to commence the making and breaking process, each jaw has to be manually opened and closed to allow the wrenches to receive pipes of varying diameter. Requiring manually operation of the jaws increases the operational time associated with the make-up and break out process and also increase the risk of injury by operator contact with the wrench assembly.

A need therefore exists for an improved jaw and jaw assemblies that reduce the time it takes to make-up or break out a tubular connection. A further need exists for increasing safety of operation of the jaws by minimizing operator contact.

SUMMARY

An improved jaw apparatus for making or breaking a tubular connection is provided that is capable of receiving pipes of various diameters through an automated means. In one example of an implementation of the invention, a jaw is providing having a head adapted to receive a hook having a threaded shank end. The threaded shank end is engaged at the head end opposite the hook end by a powered nut adjustment assembly. The adjustment assembly may be operated by a control unit to allow for the automatic opening and closing of the jaw for receiving pipes of varying diameters. When utilizing more than one jaw, such as in a wrench (or jaw) assembly, all the jaws in the assembly may be simultaneously or sequentially controlled to open and close the jaws on the pipe joints for making and breaking the joints. Simultaneous automated control of the opening and closing of the jaws provides for reduced make-up and break-up time, as well as increased safety features.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE FIGURES

The invention may be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

Figure 1:
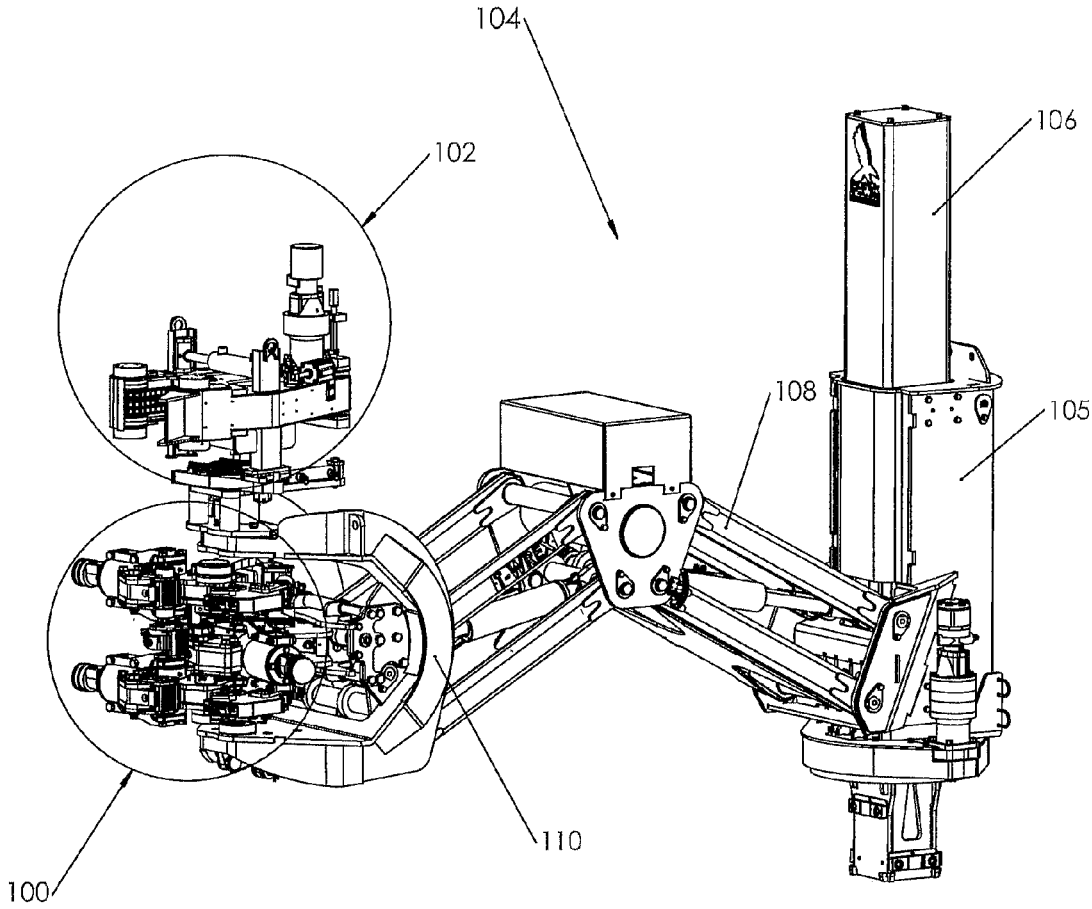
FIG. 1 illustrates a perspective view of one example of an implementation of an automatically adjustable wrench assembly mounted on a pedestal.

FIG. 1 illustrates a perspective view of one example of an implementation of an automatically adjustable wrench assembly 100 and a self-adjusting pipe spinner 102 mounted on a pedestal assembly 104. As illustrated, the pedestal assembly 104 is made up of a strong support column 106 having an extension arm 108. A C-head 110 (or mounting unit) is mounted on the end of the extension arm 108 opposite the column 106 for supporting and suspending the pipe spinner 102 and wrench assembly 100 over the wellhead of an oil well.

Fitted on the column 106 of the pedestal assembly 104 is a trolley 105. Through the use of hydraulic motors and cylinders, the trolley 105 is able to pivot the extension arm 108 about the column 106 in a horizontal direction and move the extension arm 108 up and down the column 106 in the vertical direction. The extension arm 108, also through the use of hydraulic cylinders, is able to travel longitudinally to extend or retract the position of the C-head 110 relative to the column 106. The horizontal, vertical and longitudinal movement of the extension arm 108 and C-head 110 relative to the column 106 allows for the pedestal assembly 104 to adjust the position of the adjustable wrench assembly 100 and pipe spinner 102 relative to the wellheads, mouse holes and/or pipe joints. Additionally, the C-head 110 may also be adapted to tilt relative to the extension arm 108 to adapt to, and accommodate, the make-up and break out of pipe joints that are not positioned vertical, but that extend at a slight angle relative to vertical.

Further, the adjustable wrench assembly 100 may be mounted on the C-head 110 via sets of linkages that allow the adjustable wrench assembly 100 to pivot outward, to the left, in a counter-clockwise direction when utilized for breaking out pipe joints. Similarly, when making-up pipe joints, the linkages allow for the adjustable wrench assembly 100 to pivot outward, to the right, or in the clockwise-direction.

Figure 2:
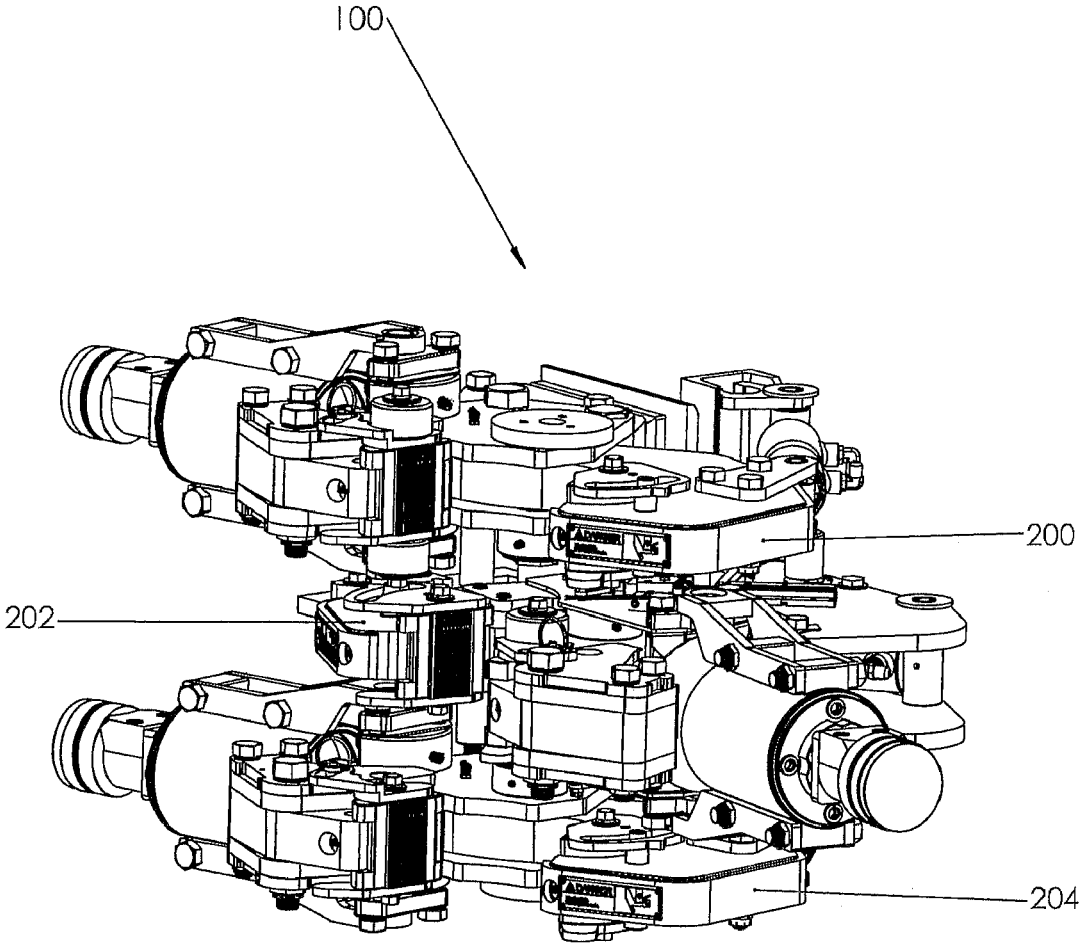
FIG. 2 illustrates a detailed view of the automatically adjustable wrench assembly encompassed by portion A of FIG. 1.

FIG. 2 illustrates a detailed view of the automatically adjustable wrench assembly 100 encompassed by portion A of FIG. 1. As illustrated by FIG. 2, the wrench assembly 100, in the illustrated example, includes three jaws 200, 202, 204 mounted in a vertically-spaced relationship to one another on the C-head 110 of extension arm 108 of the pedestal assembly 104 such that each jaw 200, 202, 204 is mounted in a horizontal plane. The top jaw is numbered 200; the middle jaw 202; and the bottom jaw 204. The top and bottom jaws 200, 204 are identical to each other and, in the illustrated example, are oriented in the same direction, such that the bottom jaw 204 is set directly below the top jaw 200. The middle jaw 202 is mounted reversely oriented relative to the top and bottom jaws 200, 204, being adapted to apply torque against a pipe inserted in the jaw opening in a direction opposite the top and bottom jaws 200, 204. The jaw openings of each set of jaws 200, 202, 204 are in vertical alignment with one another for receiving a pipe and to cooperate with the pipe spinner 102 to make-up and break pipe joints for insertion into, or removal from, the oil well over which the wrench assembly 100 and pipe spinner 102 are suspended.

In the example illustrated in FIGS. 1 and 2, all three jaws 200, 202 and 204 are identical to each other except that, as discussed above, the center jaw 202 is reversed in orientation relative to the top and bottom jaws 200, 204. Accordingly, a detailed description of one jaw will apply to all the illustrated jaws. For convenience, the middle jaw 202 will be described in detail below.

Figure 3:
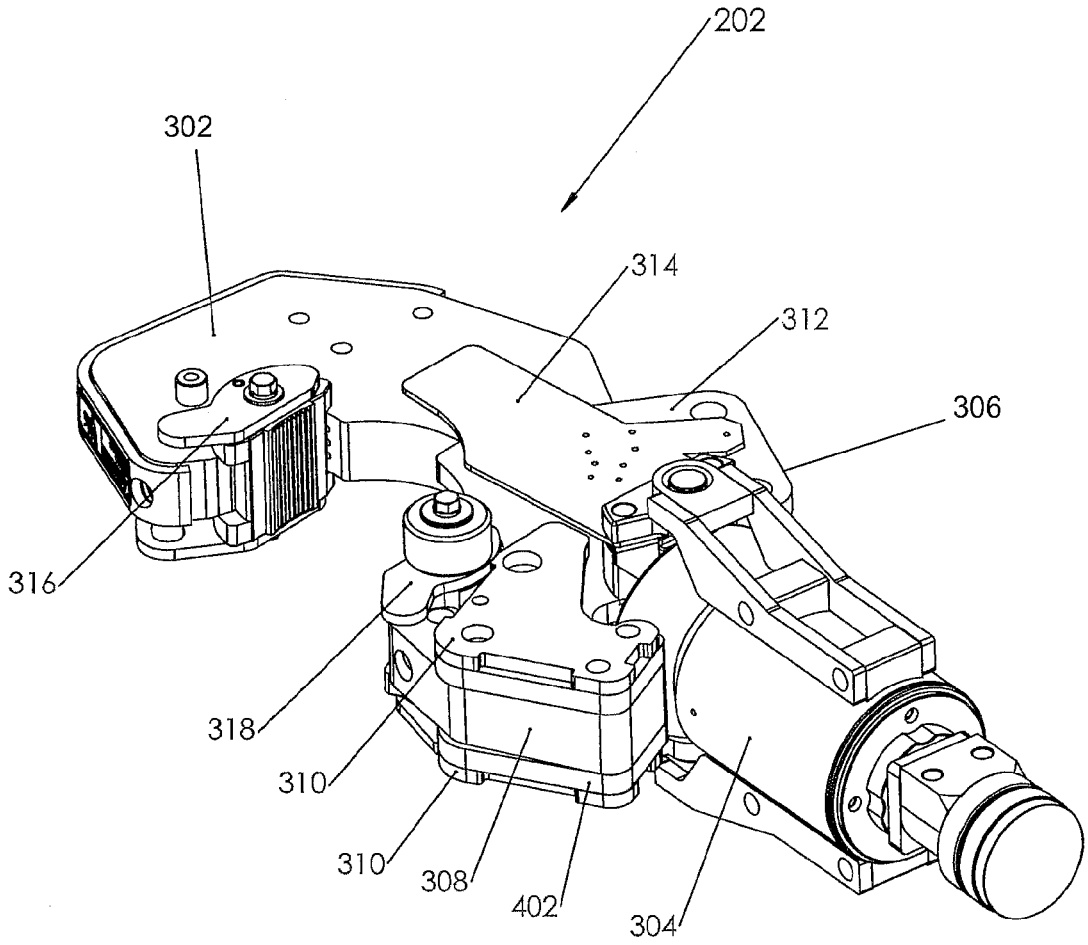
FIG. 3 illustrates a perspective view of one example of an implementation of an automatically adjustable power jaw utilized in the wrench assembly of FIG. 1.
Figure 4:
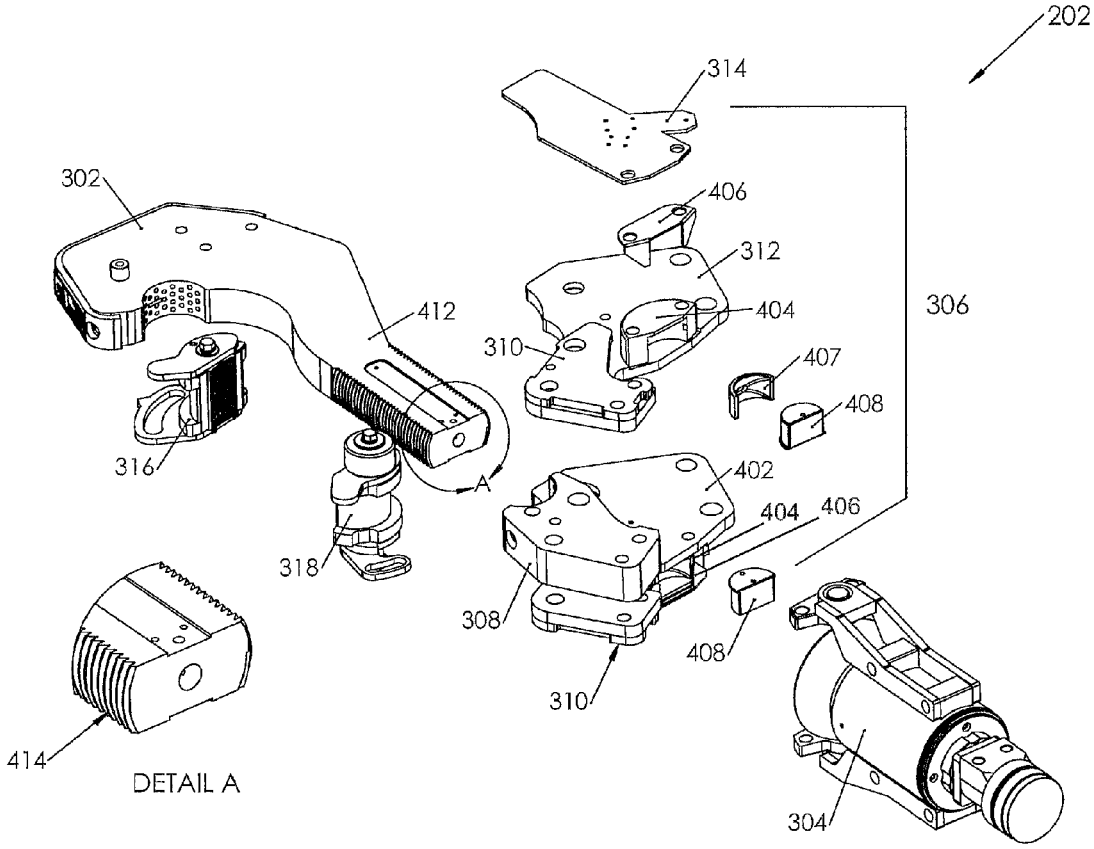
FIG. 4 is an exploded view of the adjustable power jaw of FIG. 3.

FIG. 3 illustrates a perspective view of one example of an implementation of the automatically adjustable power jaw 202 utilized in the wrench assembly 100 of FIGS. 1 and 2. FIG. 4 is an exploded view of the adjustable power jaw of FIG. 3. For illustration purposes, FIGS. 3 & 4 will be described together.

In the example illustrated in FIGS. 3 & 4, the jaw 202 includes a hook 302 having a threaded shank end 412, a head 306 and an adjustment assembly 304. Hook 302 is pivotally mounted to the head 306. The adjustment assembly 304 is also pivotally mounted to the head 306.

The jaw 202 further includes two die holder assemblies 316 and 318 for gripping the pipe joints. To grip the pipes with increasing torque and pressure, a hook die holder assembly 316 is pivotally mounted to the hook 302 and a heel die holder assembly 318 is pivotally mounted to the pivot block 308.

As shown in FIGS. 3 & 4, head 306 includes upper and lower plates 312 and 402, upper and lower doubler plates 310, and upper and lower pivot housings 404 (collectively "plate assemblies"), that are jointed together using welding processes that create a strong plate assembly. These plate assemblies are horizontally spaced apart so as to form an opening adapted to receive the shank 412 of the hook 302. The upper and lower plate assemblies are secured to each by a die pivot block 308 and nuts and bolts. Both the pivot block 308, plate assemblies and nuts and bolts are designed to secure the plate assemblies to one another while maintaining a constant position between the plate assemblies which aid in defining the opening for receiving the shank 412.

The shank 412 of hook 302 is flat on the top and bottom sides, the upper and lower surfaces of the shank lying in horizontal planes close to upper and lower plates 312, 402. The generally vertical opposite sides of shank 412, at the portion of the shank 412 remote from the hook end of hook 302, are threaded as indicated at 414. A large diameter nut adjustment assembly 304 is adapted to threadedly engage the shank end 412 of the hook 302. The relationships between the hook 302 and the nut adjustment assembly 304 are such that rotation of a portion of the nut adjustment assembly 304 causes the jaw 202 to open or close to the desired position relative to a particular diameter of the pipe joint. Furthermore, the nut adjustment assembly is pivotally mounted to the head 306 such that hook 302 and the nut adjustment assembly 304 pivots about a predetermined vertical axis relative to head 306 by pivotally attaching the nut assembly 304 to the head 306 at the upper and lower pivot housings, utilizing pivot sleeves 407, pivot pins 408, and pivot sleeve keepers 406. Optionally, a mounting plate 314 may also be provided for providing limit switches.

Figure 5:
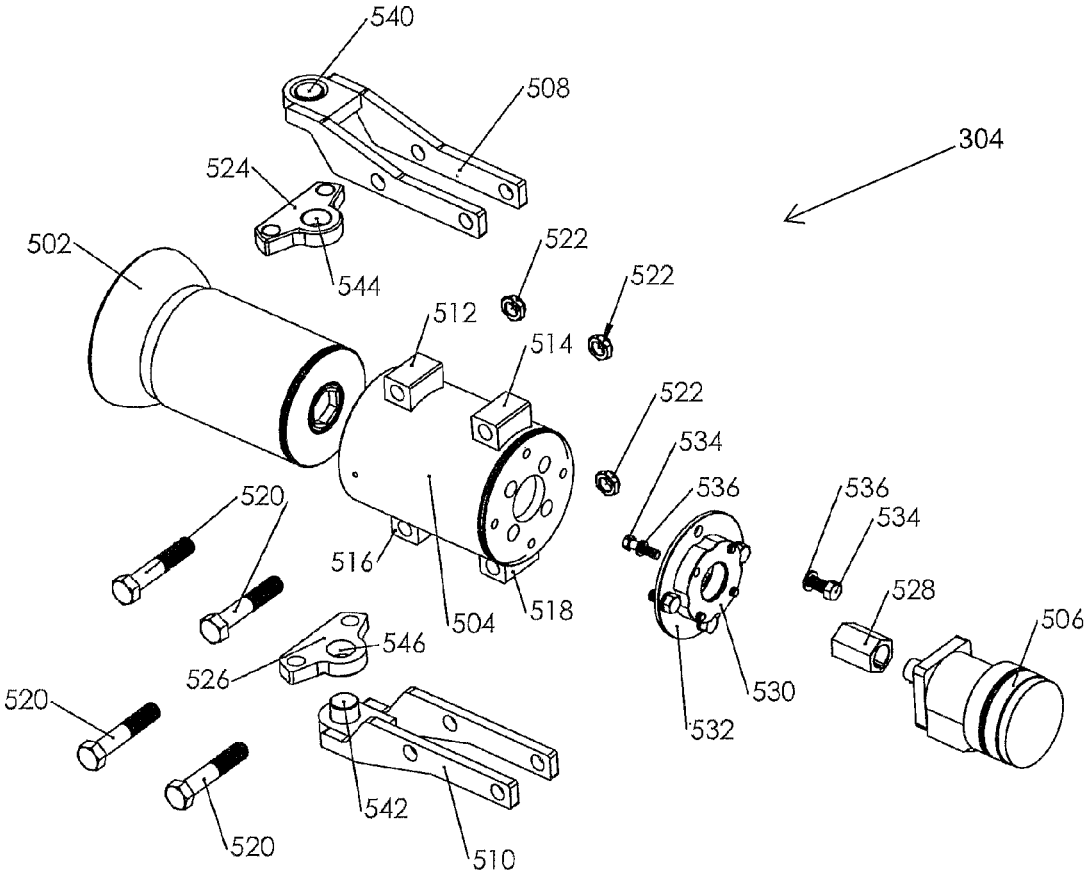
FIG. 5 is a further exploded view of the adjustment assembly of the adjustable power jaw of FIG. 4.

FIG. 5 is a further exploded view of the adjustment assembly 304 of the adjustable power jaw 202 of FIGS. 3 & 4. As illustrated, the adjustment assembly 304 includes a nut assembly 502 for threadedly engaging the shank end 412 of the hook 320. A stationary outer sleeve 504 is adapted to receive the rotating nut assembly 502. The nut assembly 502 is driven by a hydraulic motor 506. The entire adjustment assembly 304 is mounted to the head 306 utilizing upper and lower swing arms 508, 510 attached to the upper and lower portions of the outer sleeve 504 utilizing bolts 520 and nuts 522 mounted through upper mounting bars 512, 514 and lower mounting bars 516, 518 on the outer sleeve 504. The free ends of the swing arms 508, 510 pivotally attach to the upper and lower pivot housings 404, pivot sleeves 406 and pivot pins 408, 410 of the head 306 via upper and lower pivot mounts 524, 526, respectively. The free ends of the swing arms 508, 510 have integrated pivot pins 540, 542 projecting therefrom that fit within openings 544, 546 of the upper and lower pivot mounts 524, 526 to allow the adjustment assembly 304 and the hook 302 to pivot relative to the head 306.

The hydraulic motor 506 is mounted to the outer sleeve 504 via an adapter plate 532, motor mount spacer 530 secured to and between the hydraulic motor 506, and outer sleeve 504 via bolts 534 and washers 536. The nut assembly 502, outer sleeve 504, adapter plate 532 and motor mount 530 each have a central opening that align when assembled for receiving a hex shaft 528. The hex shaft is driven at one end by the hydraulic motor 506 and is in rotational engagement with the nut assembly 502 at the opposing end of the hex shaft 528 to rotate the nut assembly 502 both clockwise and counterclockwise. To engage the hex shaft 528 to rotate the nut assembly 502, the central aligning opening in the nut assembly 502 is hexagonal in shape to securely engage the hex shaft 528 and facilitate the rotation of the nut assembly 502 via the hex shaft 528.

Figure 6:
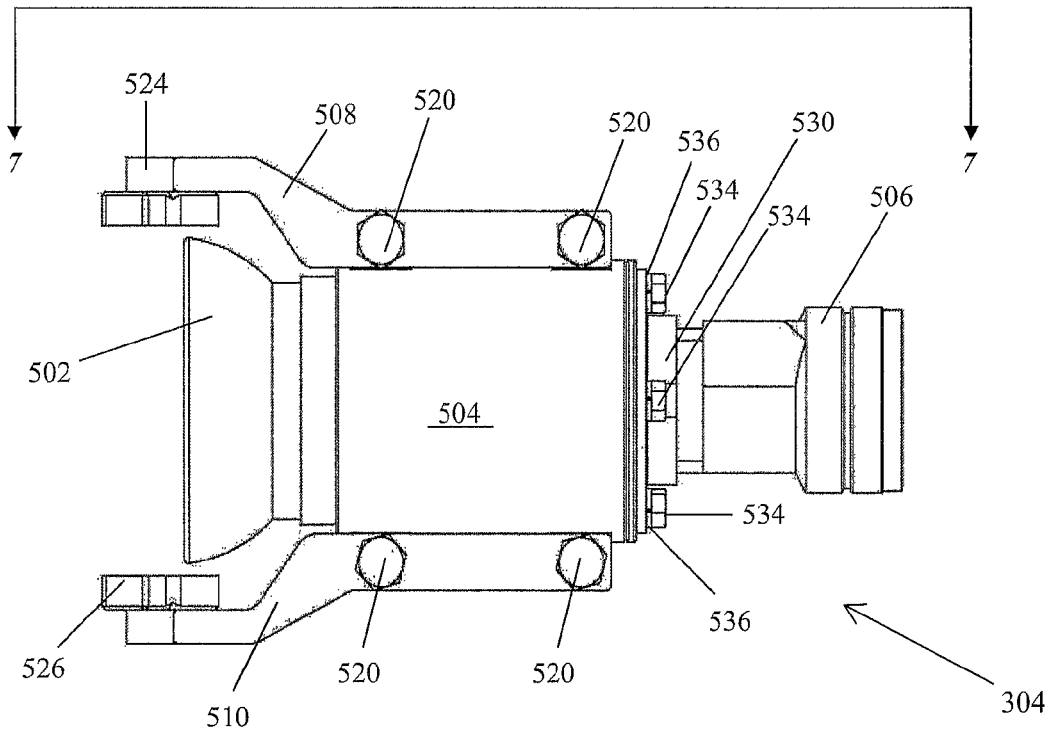
FIG. 6 is a side view of the adjustment assembly illustrated in FIG. 4.

FIG. 6 is a side view of the adjustment assembly 304 illustrated in FIG. 4. As illustrated, when assembled, the nut assembly 502 is largely positioned within the outer sleeve 504. Attached to the upper and lower portions of the outer sleeve 504 are upper and lower swing arms 508, 510 secured to the outer sleeve 504 by bolts 520. The upper and lower swing arms 508, 510 are pivotally mounted to pivot mounts 524, 526, respectively, for pivotally connecting the adjustment assembly 304 to the head 306 as illustrated in FIG. 3.

The mounting of the adapter plate 532 to the outer sleeve 504 via bolts 534 and washers 536 is further illustrated in FIG. 6. Further mounted on the adapter plate 532 is the motor mount 530, which mount the hydraulic motor 506 on the rear end of the adjustment assembly 304.

Figure 7:
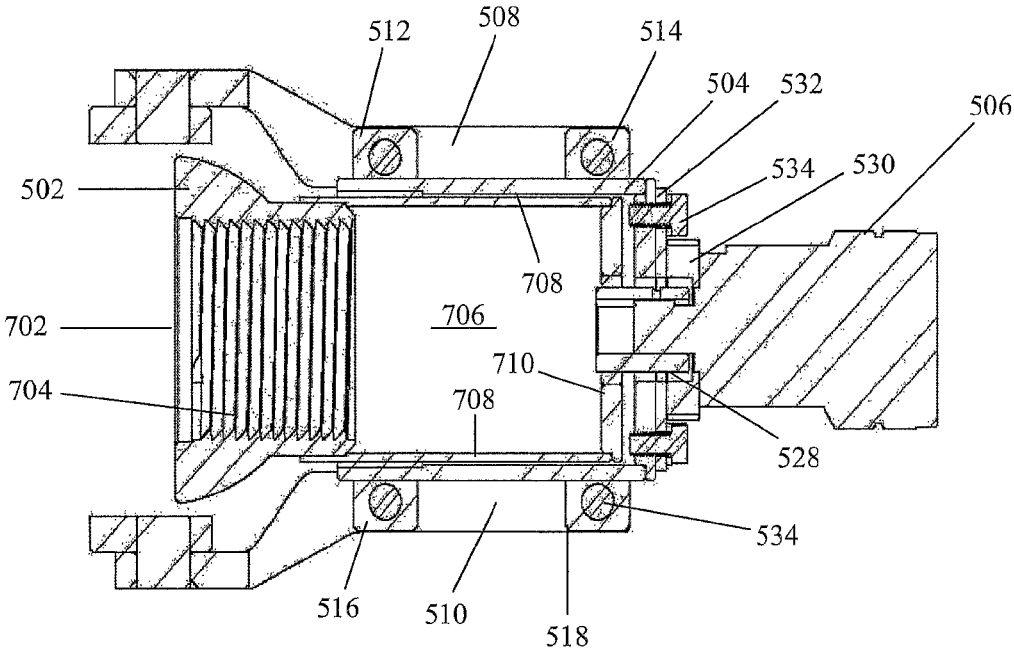
FIG. 7 is a cross-sectional view of the adjustment assembly of FIG. 6 taken along line 7-7.

FIG. 7 is a cross-sectional view of the adjustment assembly of FIG. 6 taken along line 7-7. FIG. 7 illustrates threaded opening 702 in the adjustment assembly 304 for receiving the threaded shank end 412 of the hook 302. The opening 702, about its circumference, is threaded 704 for threadedly engaging the threading 414 on the shank end 412 of the hook 302. Adjacent to the threaded opening 702 is a cavity 706 having side walls 708, and an end wall 710 for receiving the shank end 414 of the hook 302 when the hook 302 is retracted to a closed position by the turning of the nut assembly 502 in the clockwise direction, which retracts the shank end 414 into the cavity 706.

FIGS. 8 & 9 and FIGS. 10 & 11 illustrate the power jaw 202 in open and closed positions, respectively. When preparing to receive a pipe joint, the hook 302 is moved to an open position by actuation of the hydraulic motor 506, which turns the nut assembly 502. In the illustrated example, the power jaw 202 is capable of accommodating pipes of a predetermined diameter, for example 3", without any further adjustment. However, when a pipe of a larger diameter than the predetermined diameter is to be received by the power jaw 202, the jaw 202 will need to be opened wide enough to receive the larger diameter pipe. Accordingly, the nut assembly 502 is turned in the counter-clockwise direction to move the shank 412 of the hook 320 is outward, away for the adjustment assembly 304, thereby extending the hook 320 into an open position for receiving a pipe joint a larger diameter pipe.

Figure 8:
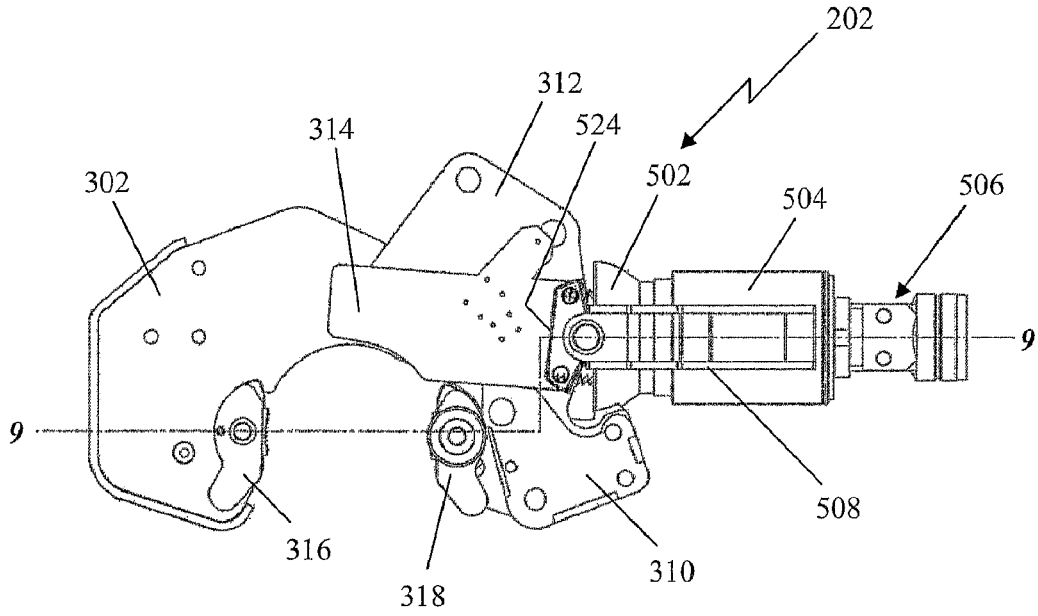
FIG. 8 is a top view of the automatically adjustable power jaw in an open position.
Figure 9:
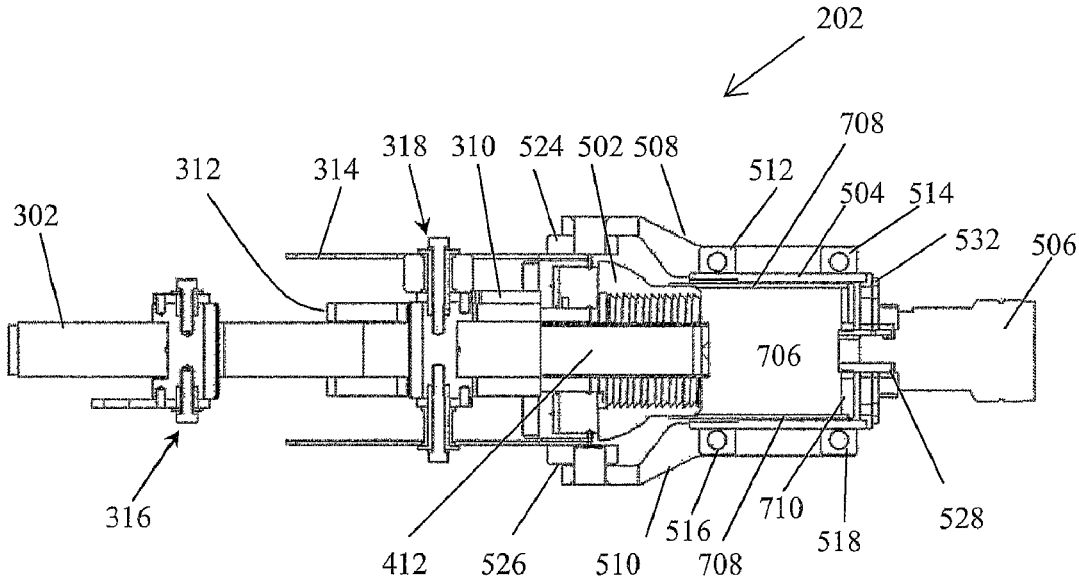
FIG. 9 is a cross-sectional view of the power jaw of FIG. 6 taken along line 9-9.

By example, FIG. 8 is a top view of the automatically adjustable power jaw 202 showing the hook 302 in an open position for receiving a larger diameter pipe joint. FIG. 9 is a cross-sectional view of the power jaw of FIG. 6 taken along line 9-9 which illustrates the shank end 412 of the hook 302 extended such that only a small portion of the shank end 412 is positioned within the cavity 706 of the nut assembly 502.

Figure 10:
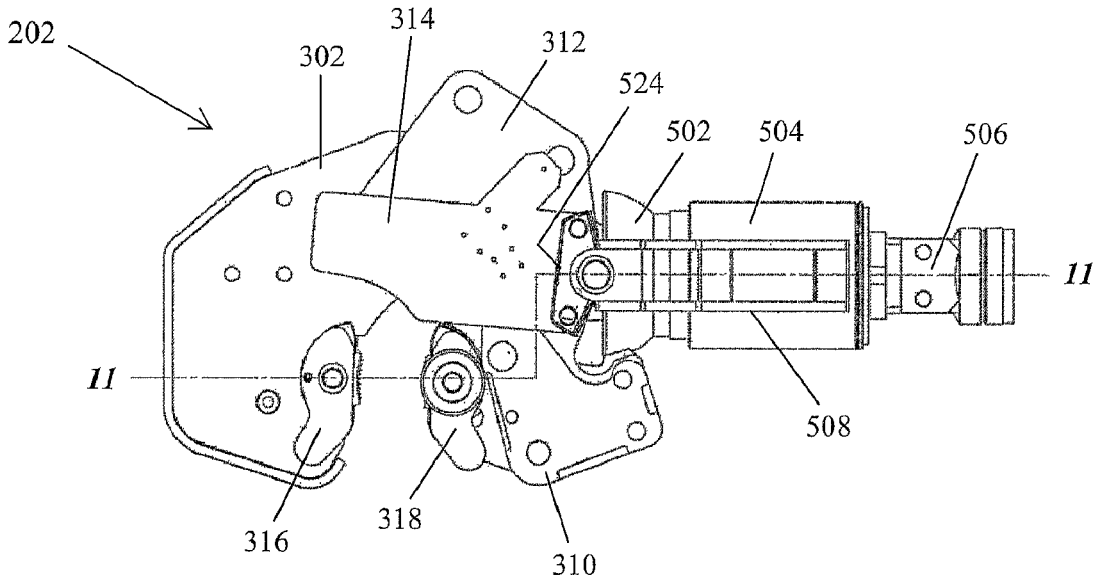
FIG. 10 is a top view of the automatically adjustable power jaw in a closed position.
Figure 11:
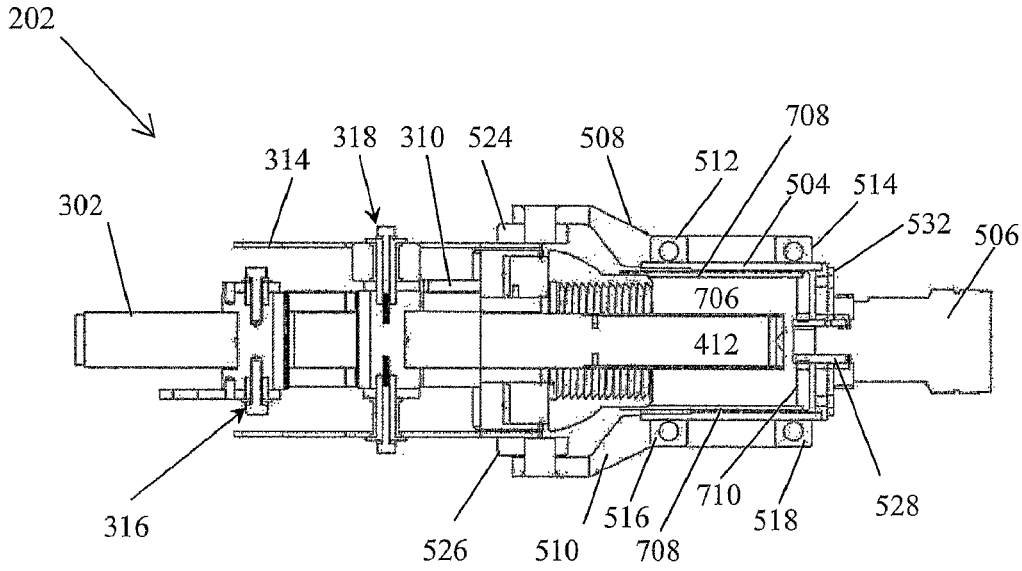
FIG. 11 is a cross-sectional view of the power jaw of FIG. 10 taken along line 11-11.

Similarly, FIG. 10 is a top view of the automatically adjustable power jaw 202 in a closed position, which may be adapted to receive a pipe of a smaller diameter, such as a 3" diameter pipe. FIG. 11 is a cross-sectional view of the power jaw of FIG. 10 taken along line 11-11, which illustrates the shank end 412 of the hook 302 retracted such that the shank end 412 of the hook 302 is positioned almost entirely within the cavity 706 of the nut assembly 502.

Figure 12:
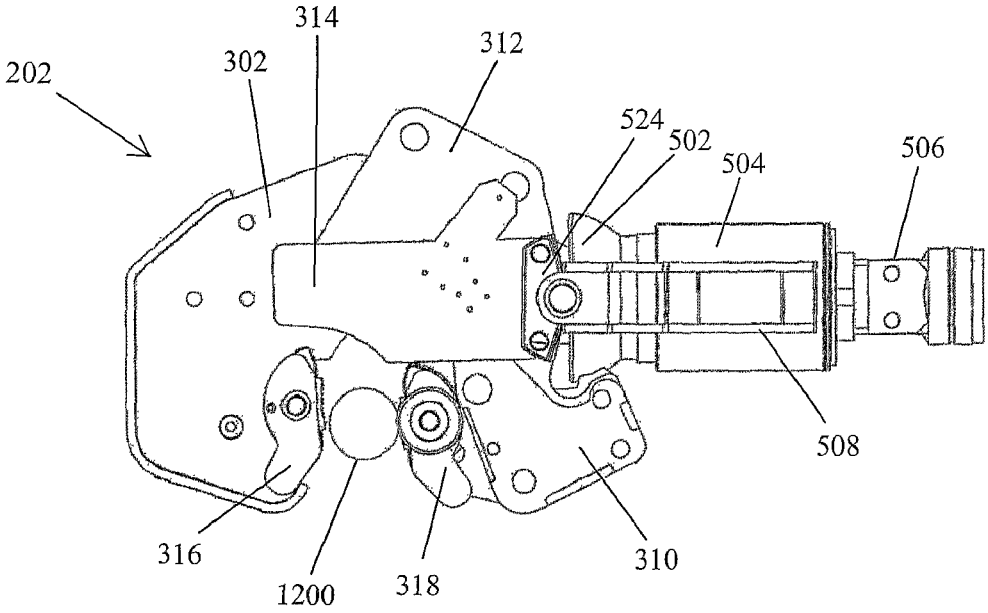
FIG. 12 is a top view of the automatically adjustable power jaw as it appears receiving a small diameter pipe.
Figure 13:
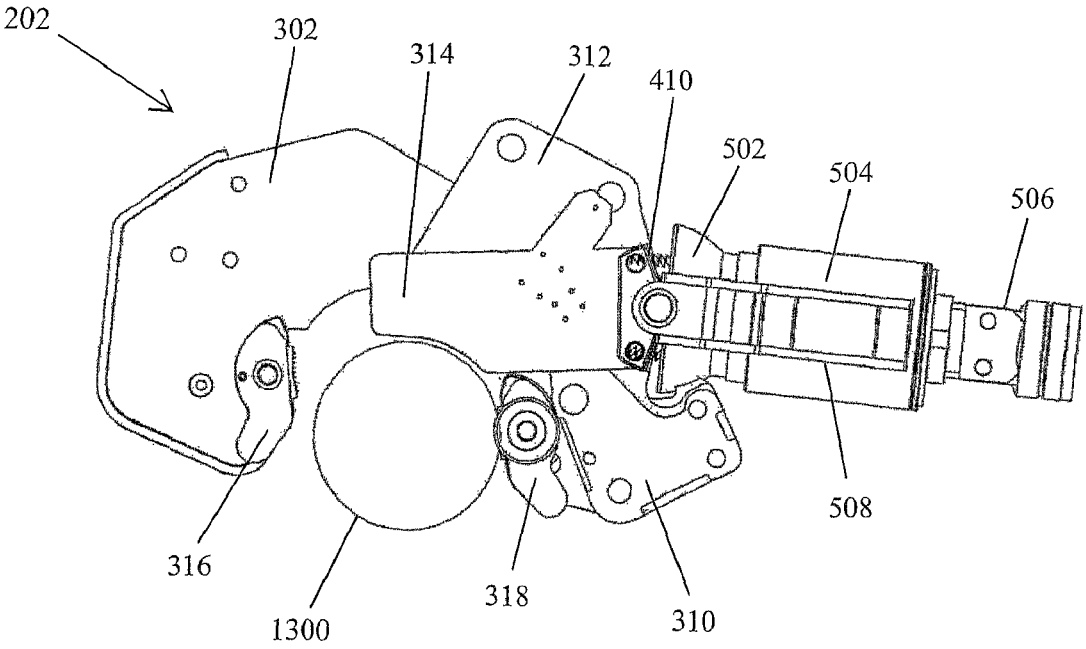
FIG. 13 is a top view of the automatically adjustable power jaw as it appears receiving a large diameter pipe.

FIG. 12 is a top view of the automatically adjustable power jaw 202 as it appears adjusted to receive a small diameter pipe. FIG. 13 is a top view of the automatically adjustable power jaw as it appears when receiving a large diameter pipe. As illustrated in FIGS. 12 and 13, the adjustment assembly 304 is capable of extending or retracting the hook assembly by threadedly engaging the shank end 412 of the hook 302 to allow for the jaw 202 to close tight enough to receive small diameter pipes 1200 as illustrated in FIG. 12, or to accommodate large diameter pipes, as illustrated in FIG. 13.

Figure 14:
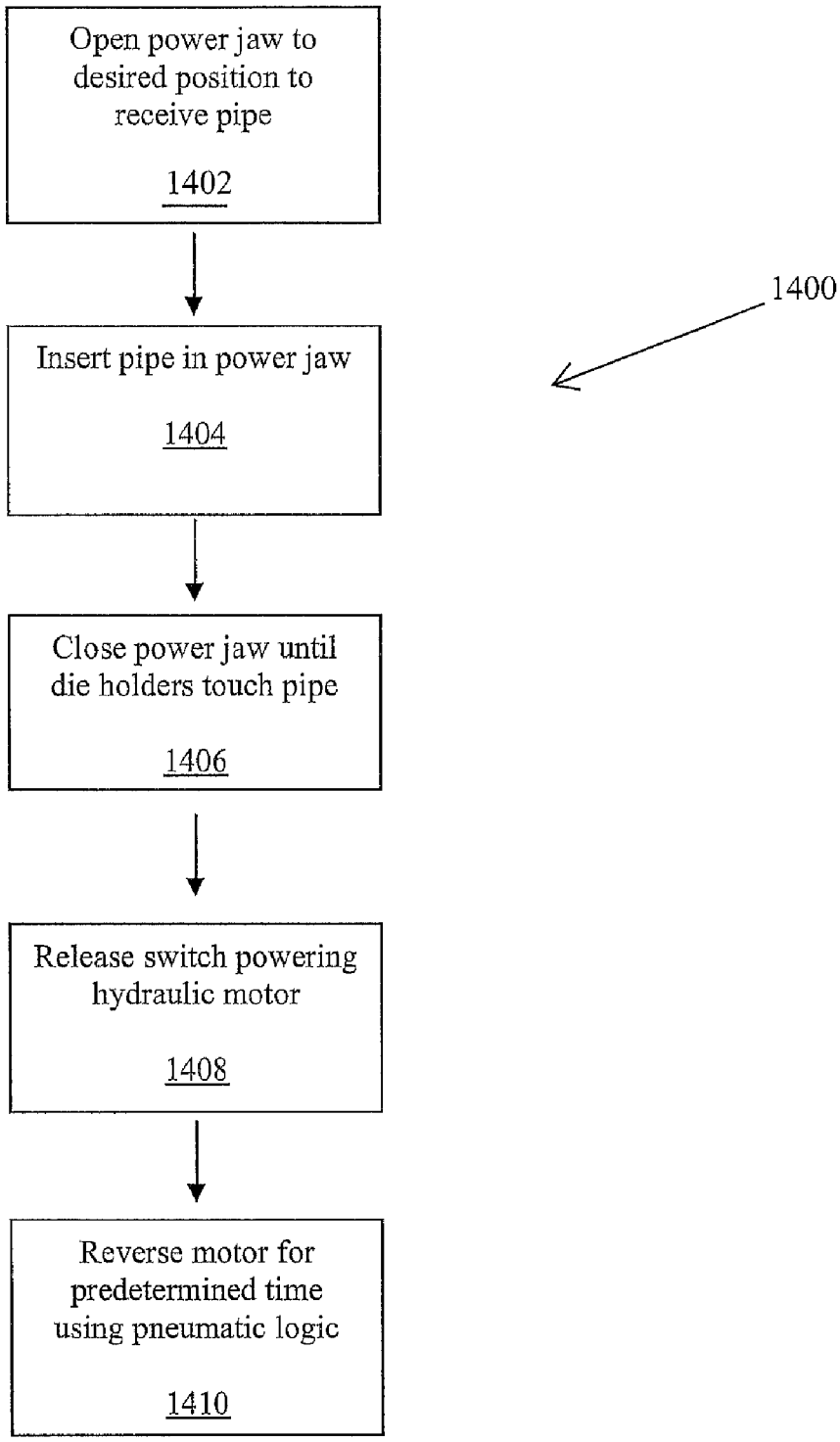
FIG. 14 is flow diagram illustrating one example of the operation of the adjustment assembly.

FIG. 14 is flow diagram 1400 illustrating one example of the operation of the adjustment assembly 304. To receive pipes of larger diameters, the power jaw 202 is first opened, at step 1402, wide enough to receive the relative pipe diameter through actuation of the hydraulic motor 506 in a direction that moves the hook 302 outward, and away from, the head 306. Once the pipe is inserted into the power jaw 202, at step 1404, the movement of the hydraulic motor 506 is reversed, closing the power jaw 202, by moving the hook 302 inward and toward the head 306 until the die holders 316, 318 touch the pipe (step 1406). Upon contact of the die holders 316, 318 with the pipe, the operator releases the hydraulic motor 506 (step 1408). Upon release of the motor 506, the system then utilizes pneumatic logic to reverse the movement of the motor for a predetermined amount of time to space the die holders away from the pipes at a predetermined distance, based upon pipe diameter (step 1410).

Figure 15:
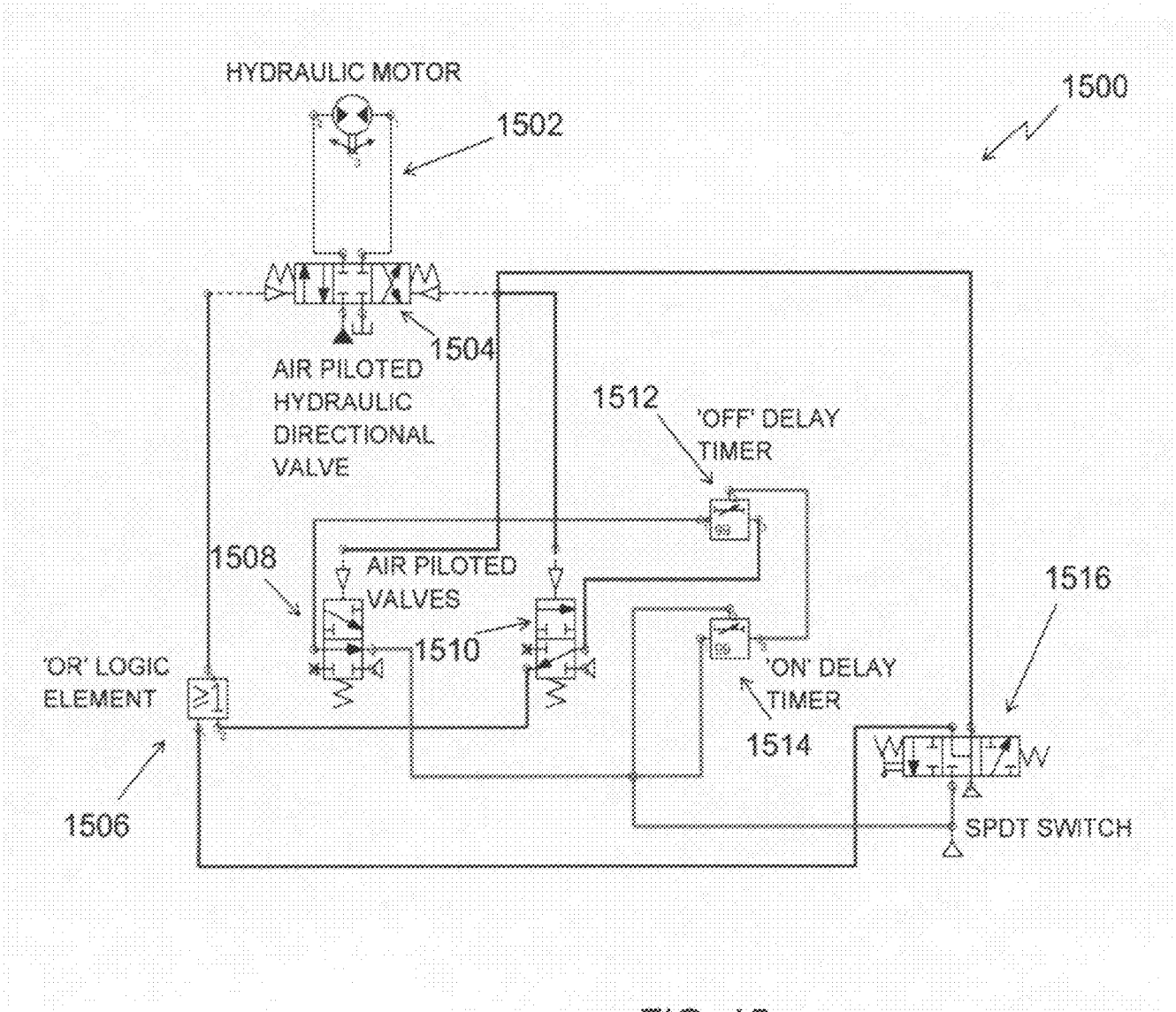
FIG. 15 is a schematic diagram of the circuit control components used to control the hydraulic motor and, by utilizing pneumatic logic, reverse the motor movement to space the die holders away from the pipes.

FIG. 15 is a schematic diagram 1500 of the circuit control components used to control the hydraulic motor 1502. As illustrated, the circuit components include a hydraulic directional valve 1504 in communication with the hydraulic motor 1502. The hydraulic directional valve 1504 controls the direction of the hydraulic motor 1502. The components further include a logic element, 1506, which in this case is an "or" logic element, a first and second piloted valve 1508 and 1510, an "off" delay timer 1512, an on delay timer 1514 and a SPDT switch 1516.

In operation, the control system is designed to utilize pneumatic logic, using an "or" logic element 1506, to reverse the motor 1502 movement upon contact of the die holder 316, 318 with the pipe. The motor movement is reversed for a predetermined time to space the die holders 316, 318 away from the pipe at a predetermined distance, as illustrated in step 1410 of FIG. 14. For purposes of this description, when the die holders 316, 318 are moving toward the pipe, the motor 1502 shall be characterized as moving in the forward direction. When the die holders 316, 318 are moved away from the pipe after contact, the motor 1502 shall be characterized as moving in the reverse direction.

To run the motor 1502 in the forward direction, the pneumatic single pole double throw ("SPDT") switch 1516 is engaged and the air piloted valves 1508, 1510 are closed, thereby initiating the time circuit consisting of the "on" and "off" delay timers. 1514, 1512. The pneumatic single pole double throw ("SPDT") switch 1516 is engaged utilizing a spring loaded switch that is returned to center when released.

As illustrated in FIG. 15, to signal the motor 1502 to run in reverse, the SPDT switch 1516 is engaged, resulting in a direct connection between the SPDT switch 1516 and the hydraulic directional valve 1502.

The time circuit consists of the "off" delay timer 1512 and the "on" delay timer, both of which includes one air supply, one signal and one output. In operation, the timer is signaled with a negative drop to zero in air pressure, an internal valve connects the air supply so that air is output for a predetermined amount of time. Once the predetermined time has elapsed, the timer breaks the internal valve connection and stops the supply of air. Thus, the timer shuts off the air supply to the hydraulic directional valve 1504 to cease the operation of the motor 1502 in the reverse direction.

Upon initial start up of the system, the "on" timer is arranged to delay the air supply to the "off" timer. This delay allows the "off" timer to do one time cycle on initial pressurizing of the circuit.

Figure 16:
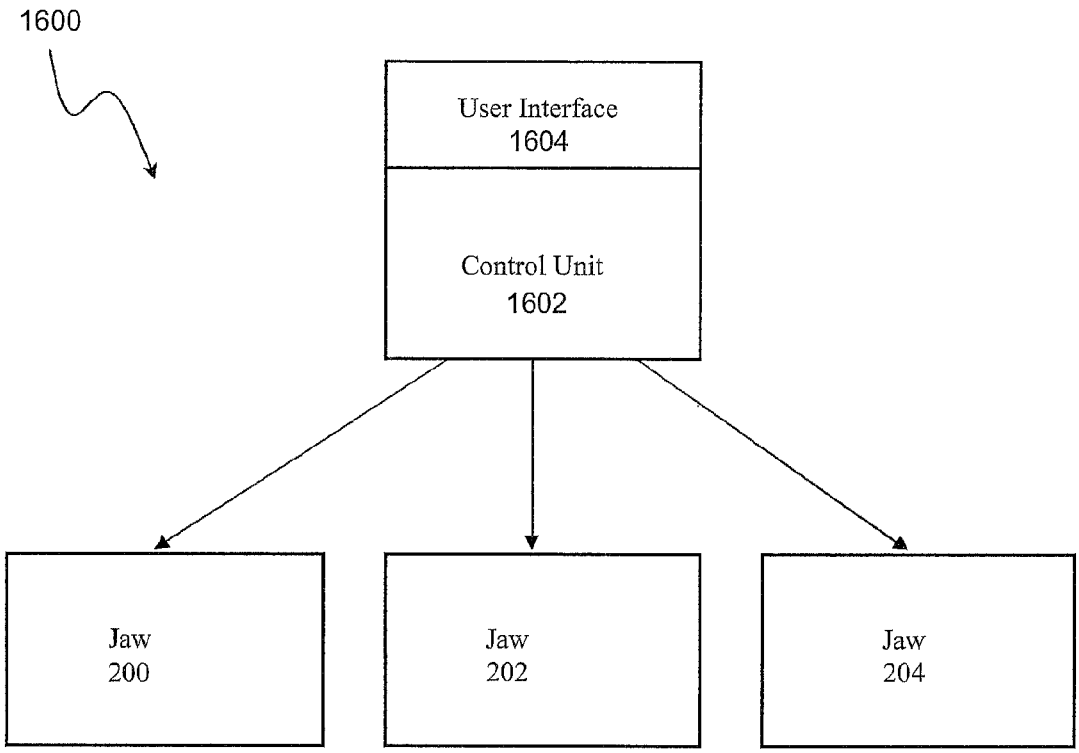
FIG. 16 is a block diagram illustrating a system for automatically adjusting the plurality of power jaws mounted on a tool joint to accommodate pipes of varying sizes.

FIG. 16 is a block diagram illustrating a system for automatically adjusting a plurality of power jaws 200, 202, 204 when mounted on a pedestal assembly 104 (FIGS. 1 & 2) to accommodate pipes of varying sizes. By utilizing automatically adjusting power jaws 200, 202, 204, the jaws may be remotely adjusted from an operator's console which, as illustrated in FIG. 16, may include a control unit 1602 and a user interface 1604. The control unit 1602 is adapted to adjust the power jaws 200, 202, 204 by controlling the operation, including the directional operation, of the hydraulic motor 506 as required to accommodate various pipe diameters. For example, the control unit 1602 may allow the operator, via the user interface 1604, to open the power jaws to wide enough to receive large diameter pipe joints for which the power jaws 200, 202, 204 are to make or break. While the opening and closing of the power jaws 200, 202, 204 may be controlled by the operator of the control unit 1602. The control unit 1602 may be program with predetermined setting for various pipe sizes, which may be similar to the pipe size 1200 illustrated in FIG. 12. Then the control unit 1602, based upon predetermined settings, opens the power jaw 200, 202, 204 wide enough to receive a pipe of such diameter by controlling the operation of the hydraulic motor 506 (see FIG. 10). Further, the control unit 1602, once the pipe is insert into the power jaws 200, 202, 204 may then initiate the hydraulic motor 506 to turn the nut assembly 502 until the die holders 316, 318 touch the pipe. Once the die holders 316, 318, touch the pipe, the die holders 316, 318 are then backed off the pipe by reversing the motor for a predetermined time. Depending upon the sophistication of the control unit 1602 and the processes stored in memory, the operation of the hydraulic motor 506 may be entirely or partially controlled by user actuation and/or execution of instructions stored in the memory of the control unit 1602.

When a control unit 1602 is utilized in connection with multiple power jaws 202, as illustrated in FIG. 16, the jaw adjustment may be made simultaneously. Alternatively, the jaw adjustments of each jaw may be made sequentially. In either case, by providing for automated jaw adjustment without the need for manually adjustment, adjustment time is minimized. Further, the safety of operations of the jaws is increased by minimizing operator contact with the jaws.

It will be understood, and is appreciated by persons skilled in the art, that one or more processes, sub-processes, or process steps described in connection with FIGS. 8-15 may be controlled by hardware and/or software. If the process is performed by software, the software may reside in software memory (not shown) in a suitable electronic processing component or system such as, one or more of the functional components or modules schematically depicted in FIGS. 14 & 15. The software in software memory may include an ordered listing of executable instructions for implementing logical functions (that is, "logic" that may be implemented either in digital form such as digital circuitry or source code or in analog form such as analog circuitry or an analog source such an analog electrical, sound or video signal), and may selectively be embodied in any computer-readable medium for use by or in connection with an instruction execution system, apparatus, or device, such as a computer-based system, processor-containing system, or other system that may selectively fetch the instructions from the instruction execution system, apparatus, or device and execute the instructions. In the context of this disclosure, a "computer-readable medium" is any means that may contain, store or communicate the program for use by or in connection with the instruction execution system, apparatus, or device. The computer readable medium may selectively be, for example, but is not limited to, an electronic, magnetic, optical, electromagnetic, infrared, or semiconductor system, apparatus or device. More specific examples, but nonetheless a non-exhaustive list, of computer-readable media would include the following: a portable computer diskette (magnetic), a RAM (electronic), a read-only memory "ROM" (electronic), an erasable programmable read-only memory (EPROM or Flash memory) (electronic) and a portable compact disc read-only memory "CDROM" (optical). Note that the computer-readable medium may even be paper or another suitable medium upon which the program is printed, as the program can be electronically captured, via for instance optical scanning of the paper or other medium, then compiled, interpreted or otherwise processed in a suitable manner if necessary, and then stored in a computer memory.

The foregoing description of implementations has been presented for purposes of illustrations and description. It is not exhaustive and does not limit the claimed inventions to the precise form disclosed. Modifications and variations are possible in light of the above description or may be acquired from practicing the invention. For example, although the above illustrated descriptions and illustrations show the use of a hydraulic motor 506 to drive the nut adjustment assembly 304, other types of motors known for rotatably driving the mechanical engagement of components, such as, for example, a pneumatic motor or electric motor may also be utilized to drive the nut adjustment assembly 304 of the invention. Further, although the above illustrated examples of implementations show the wrench assembly mounted on the C-head of a pedestal assembly having an extension arm, the wrench assembly may also be suspended over the wellheads and mouse holes by suspension systems, such as the three-element suspension system or other known suspension systems utilized in the industry to suspend wrench assemblies or power tong assembly over wellheads or mouse holes. Additionally, the powers jaws or wrenches of the invention may be sold individually, as part of the wrench assembly, or as part of a system that includes both a pedestal or suspensions system and wrench assembly and which may or may not include a spinner assembly. The claims and their equivalents define the scope of the invention.

We claim:

1. An adjustable wrench assembly for engaging and applying high torques to sections of threadedly connected pipe, comprising:

at least one jaw having a head and a hook pivotally mounted to the head for engaging a pipe;

a nut adjustment assembly for opening and closing the hook of the wrench relative to the head, where the hook includes a threaded shank end, the head includes an opening for receiving the shank end of hook and allowing the shank end to pass through the opening of the head for engagement at the threaded shank end with the nut adjustment assembly;

a motor in mechanical communication with the nut adjustment assembly to drive the nut adjustment assembly to open and close the wrench; and a control unit for in communication with the motor controlling the operation of the motor.

2. The adjustable wrench assembly of claim 1 where the motor is a hydraulic motor.

3. The adjustable wrench assembly of claim 1 where the control unit includes a user interface.

4. The adjustable wrench assembly of claim 1 where the nut adjustment assembly is pivotally mounted to the head.

5. The adjustable wrench assembly of claim 1 where the wrench assembly comprises at least three jaws.

6. The adjustable wrench assembly of claim 5 further including a pedestal assembly having a column, an extension arm extending at one end from the column and having a mounting unit affixed to the extension arm at its opposing end for mounting the wrench assembly.

7. A power jaw for engaging and applying high torques to sections of threadedly connected pipe, comprising:

a hook having a threaded shank end;

a head adapted to receive the threaded shank end of the hook; and a hydraulic powered nut adjustment assembly for engaging the threaded shank end of the hook at the end of the head opposite the hook.

8. The power jaw of claim 7 where the nut adjustment assembly is pivotally mounted to the head.

9. The power jaw of claim 8, where the hook is pivotally mounted to the head.

10. An automatically adjustable wrench assembly for engaging and applying high torques to sections of threadedly connected pipe, comprising:

a pedestal assembly having a column, an extension arm extending at one end from the column and having a mounting unit affixed to the extension arm at its opposing end; and a plurality of jaws having a head, a hook and a hydraulic powered nut adjustment assembly for opening and closing the hook of the jaw relative to the head.

11. The wrench assembly of claim 10 where the hook portion includes a threaded shank end, the head includes an opening for receiving the shank end of hook and allowing the shank end to pass through the opening of the head for engagement at the threaded shank end with the nut adjustment assembly.

12. The wrench assembly of claim 10 where the nut adjustment assembly is pivotally mounted to the head.

13. The wrench assembly of claim 10, where the hook is pivotally mounted to the head.

14. The wrench assembly of claim 10 where the wrench assembly comprises at least three jaws.

15. A method for automatically adjusting the size of the opening of a power jaw having a head assembly and a hook for receiving and applying torque to pipes of varying diameters, the method comprising the steps of:

actuating a hydraulic motor for driving a nut adjustment assembly threadedly engaged to the hook pivotally attached to the head assembly to open the hook relative to the head;

reversely actuating the hydraulic motor to close the book relative to the head once the pipe is inserted into the power jaw;

releasing the actuation of the hydraulic motor once the hook and head assemblies come in contact with the pipe;

reversing the direction of the hydraulic motor for a predetermined amount of time to position the hook and head away from the pipe at a predetermine distance prior to the application of torque to the pipe.

16. The method of claim 15 where pneumatic logic is applied to determine the predetermined amount of time in which to reverse the direction of the hydraulic motor for a given pipe diameter.

17. The method of claim 15 where the hook and head both include die holders and direction of the hydraulic motor is reversed when the die holders contact the pipe.

18. The method of claim 15 where the steps are carried out by a user actuated control unit.

* * * * *